US005913357A

United States Patent [19]

Hanazaki et al.

[11] Patent Number: 5,913,357

[45] Date of Patent: Jun. 22, 1999

[54] METHOD FOR CONTROLLING THE LEVEL OF MOLTEN METAL FOR A CONTINUOUS CASTING MACHINE

[75] Inventors: Kazuharu Hanazaki; Masahiko Oka, both of Kashima, Japan

[73] Assignee: Sumitomo Metal Industries, Ltd., Osaka, Japan

[21] Appl. No.: 08/849,909

[22] PCT Filed: Oct. 15, 1996

[86] PCT No.: PCT/JP96/02984

§ 371 Date: Jun. 18, 1997

§ 102(e) Date: Jun. 18, 1997

[87] PCT Pub. No.: WO97/14521

PCT Pub. Date: Apr. 24, 1997

[30] Foreign Application Priority Data

Oct. 18, 1995 [JP] Japan ..... 7-270345

[51] Int. Cl.[6] ..... B22D 11/18; B22D 11/20

[52] U.S. Cl. ..... 164/453; 164/454

[58] Field of Search ..... 164/453, 452, 164/454, 449.1

[56] References Cited

FOREIGN PATENT DOCUMENTS 57-209763 12/1982 Japan .

5-23811 2/1993 Japan .

5-104222 4/1993 Japan .

5-277688 10/1993 Japan .

7-22812 3/1995 Japan .

8-19846 1/1996 Japan .

*Primary Examiner*—Kuang Y. Lin

*Attorney, Agent, or Firm*—Burns, Doane, Swecker & Mathis, L.L.P.

[57] ABSTRACT

In order to control a molten metal level within a mold of a system comprising a liquid core reduction device, while controlling a fluctuation of the molten metal level caused by a change of operational conditions, such as the withdrawal rate, reduction speed, etc., with improvement of the yield rate of product slabs, a method comprises the steps of: (i) estimating a disturbance to the molten metal level, which is caused by a change in operating conditions of a continuous casting machine before changing the operating conditions; (ii) determining an amount of correction of the control signal to eliminate the disturbance, and determining a delay time of the operation of the pouring means in responses to the control signal after correction; and (iii) applying a control signal containing the amount of correction in advance by a period of the delay time prior to the occurrence of a change in operating conditions.

4 Claims, 5 Drawing Sheets

METHOD FOR CONTROLLING THE LEVEL OF MOLTEN METAL FOR A CONTINUOUS CASTING MACHINE

TECHNICAL FIELD

The present invention relates to a method for controlling the level of molten metal so as to keep a target level within a mold in the course of casting with a continuous casting machine.

BACKGROUND ART

A casting operation with a continuous casting machine is carried out by the steps of: pouring a molten metal into an upper opening of a cylindrical mold having a water-cooled inner wall and upper and lower openings, cooling the molten metal through the wall in contact with the molten metal to provide a cast slab having an outer solidified shell, continuously withdrawing the cast slab from the lower opening of the mold, further cooling the cast slab, and cutting the solidified slab to a predetermined length after the central portion thereof is solidified to provide a product slab to be used as a starting material for rolling, etc.

In carrying out continuous casting, it is necessary not only to improve productivity by preventing defects such as overpouring and break-out, occurrence of which is undesirable for stable operation, but also to improve quality of product slabs by achieving uniform cooling and solidifying of molten metal within a mold. One means for achieving these goals is to control the level of molten metal so as to keep a predetermined level within a mold.

The level of molten metal is generally controlled using feedback by detecting the molten metal level within a mold, by calculating PID on the basis of deviation between the determined level and the target level so as to determine an operating position of a pouring means such as a sliding gate and a stopper, which are provided in a pouring nozzle to control pouring into the mold, and supplying a control signal to operate an actuator, e.g., an oil hydraulic cylinder for the pouring means to make the deviation zero.

However, in the operation of a continuous casting machine, deposition and removal of precipitates such as alumina onto or from a contact surface between the molten metal and the pouring means, for example, repeatedly occur, and a gain of pouring rate of the molten metal passing through the pouring means varies, resulting in a fluctuation in the molten metal level. In addition, since the inside of the cast slab when it is pulled downward out of the mold is in an unsolidified state, the cast body repeatedly swells and shrinks between pinch rolls. This phenomena is called bulging. As bulging occurs, molten metal within the cast slab is forced up or down, resulting in a level fluctuation of molten metal within the mold.

Thus, there are many disturbances affecting molten metal level control. On the other hand, nowadays, it is greatly desired to increase the casting rate in a continuous casting operation. It is difficult, therefore, to control the molten metal level with great accuracy and a quick response time even by employing feedback control In the past, as disclosed in Japan Patent Laid-Open Application No. 5-23811/1993, disturbances were successively estimated by using a control signal applied to a molten metal pouring means or a signal indicating the operating position of the pouring means together with a signal indicating the molten metal level within a mold, and correction was made to the control signal so that estimated disturbances were eliminated. Thus, a method of controlling the molten metal level with high accuracy and a quick response time was employed to give intended effects to a certain extent.

On the other hand, sometimes a withdrawing rate of a cast slab out of a mold must be varied during operation of a continuous casting machine depending on the specifications of the product slabs. In addition, in order to produce product slabs having a good internal structure, sometimes the thickness of cast slabs withdrawn out of a mold must be reduced while the slabs have a liquid core, i.e., a liquid core reduction device. Changes in operating conditions in these cases result in a level fluctuation of molten metal within the mold.

In the past, when changes in operating conditions were expected because the withdrawing rate increased or decreased, or the liquid core reduction was carried out, disturbances resulting in a level fluctuation of molten metal within tho mold were estimated, and control for compensating for the variation was previously determined. Feed forward control was carried out to apply additional signals to the control signal for a pouring means at the beginning of changing the operating conditions so as to suppress a transient change of the molten metal level within the mold.

Such a variation in the molten metal level is large and occurs in a rapid change. On the other hand, a system to be finally controlled is a pouring means which is operated in a mechanical manner. The molten metal level moves a marked distance away from a target level before the pouring means finishes its operation in response to a control signal including a signal to compensate for the before-mentioned disturbances. During this transient period after the operating conditions are changed, product slabs degrade with respect to their quality and they must be cut off, resulting in a decrease in the product yield.

These problems can be solved to some extent by employing a control system disclosed in the before-mentioned Japanese Patent Application Laid-Open Specification No. 5-23811, for example, by improving response properties of the control system and by employing a translation actuator, i.e., a stepping cylinder, as an actuator for the pouring means so that the mechanical response of the pouring means can be improved. However, such a solution is not adequate when high speed operation is carried out.

Furthermore, recently, liquid core reduction has been practiced to produce a thin cast slab. According to this process, since a reduction in thickness is applied to a cast slab while the slab has a liquid core, a thin slab can be produced under a relatively mild load. A fluctuation of the molten metal level within the mold, however, is inevitable in this process because molten metal is squeezed from the core portion of the slab when a liquid core reduction is applied to the slab.

SUMMARY OF THE INVENTION

An object, therefore, of the present invention is to provide a process for controlling a molten metal level within a mold of a continuous casting machine. According to the present invention, a fluctuation of the molten metal level caused by a change in operating conditions, e.g., a change in a withdrawing rate of a cast slab out of the mold, or a change in a rate of liquid core reduction can successfully be suppressed, so that control can be performed precisely during operation, resulting in an improvement in the yield of the product.

The present invention is a process for controlling a molten metal level within a mold of a continuous casting machine, which comprises detecting the molten metal level within the mold successively during casting operation, comparing the detected level with a target level to determine a difference between the two levels, applying a control signal to control a pouring means so as to make the difference zero, and adjusting the amount of molten metal poured into the mold by the operation of the pouring means, characterized by the steps of (i) estimating a disturbance to the molten metal level, which is caused by a change in operating conditions of a continuous casting machine before changing the operating conditions;

(ii) determining an amount of correction of the control signal to eliminate the disturbance, and determining a delay time of the operation of the pouring means in response to the control signal after correction; and (iii) applying a control signal containing the amount of correction in advance by a period equal to the delay time prior to the occurrence of a change in operating conditions.

BEST MODE FOR CARRYING OUT THE INVENTION

Figure 1:
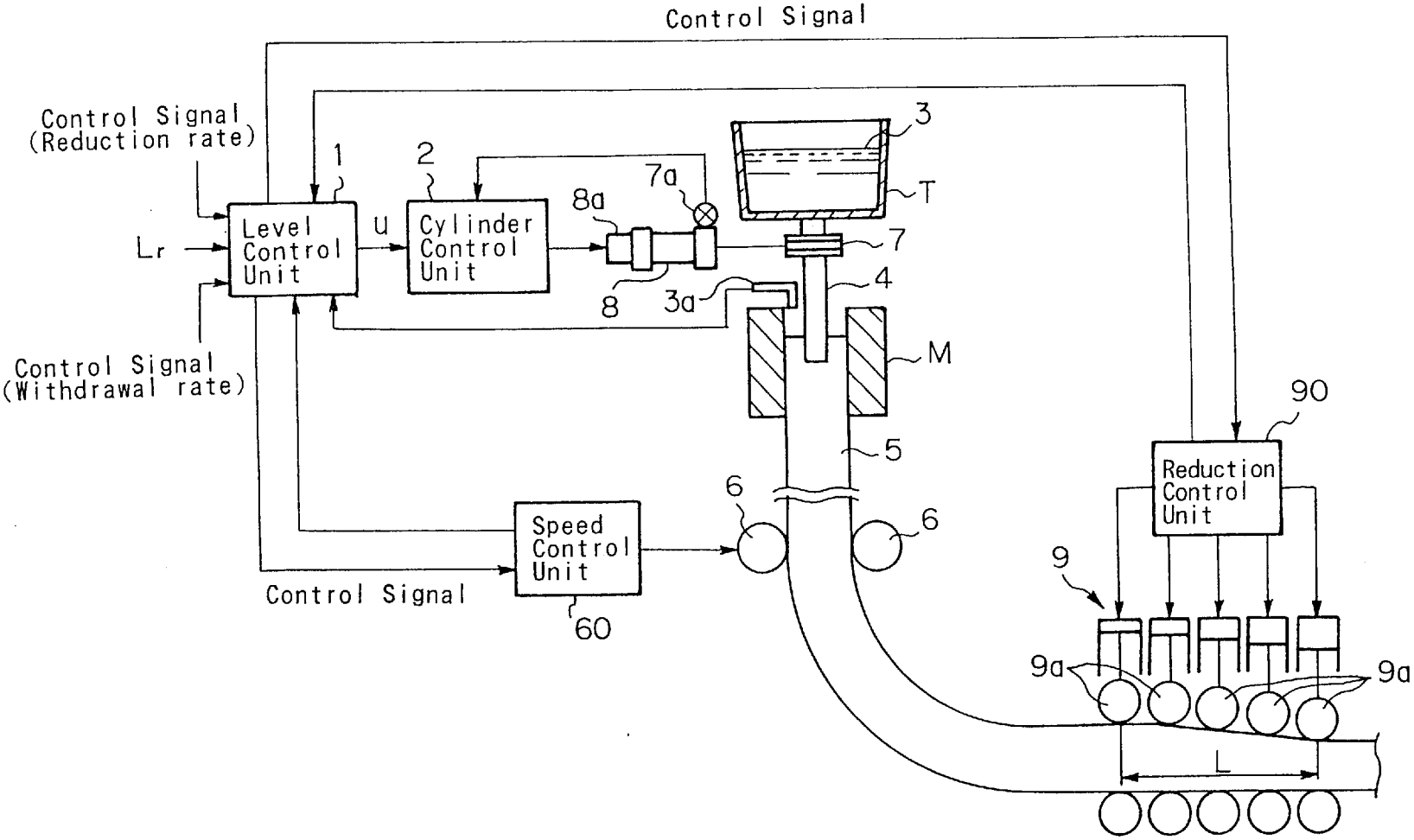
FIG. 1 is a block diagram showing an embodiment of a method of the present invention.

FIG. 1 in a block diagram showing an embodiment of a method of controlling a molten metal level within a mold of a continuous casting machine in accordance with the present invention (hereunder referred to as merely "the method of the present invention").

In the drawings, the symbol T stands for a tundish within which molten metal 3 is temporarily kept. A mold M having upper and lower openings is positioned at an appropriate distance below the tundish T. Within the mold M is provided an immersing nozzle 4, one end of which opens into the bottom of the tundish T. Accordingly, molten metal 3 kept within the tundish T is poured through the immersing nozzle 4 into the mold, where the poured molten metal is cooled in contact with the inner wall of the mold M to make a cast slab 5 having a liquid core and a solidified shell which covers the core. The cast slab 5 is continuously withdrawn downwardly from the mold M through pinch rolls 6, 6 rotating along the outside surface of the slab. After leaving the mold, the cast slab is further cooled until solidification of the core portion is finished. The solidified slab is cut to an appropriate length to obtain product slabs.

In the immersing nozzle 4 a sliding gate 7 is provided so as to control the amount of molten metal poured into the mold M by the movement of a gate plate on a plane substantially perpendicular to the longitudinal direction of the nozzle. A gate plate of the sliding gate 7 is connected to the top end of an output rod for a stepping cylinder 8. The control of the amount of molten metal to be poured into the mold is carried out using the stepping cylinder 8 by moving the gate plate thereof so as to adjust the degree of opening of the immersing nozzle 4.

The degree of opening of the sliding gate 7 can be detected based on the position of the output rod by an opening-detector 7*a* associated with the stepping cylinder 8. The surface level of the molten metal 3 kept within the mold M, i.e., the molten metal level is detected by a level detector 3*a* disposed opposite the molten metal 3. Data detected by the level detector 3*a* are provided to a level control unit 1 together with a target level to which the system is to be controlled.

The level control unit 1 compares the molten metal level detected by the level detector 3*a* within the mold M with the target level and calculates the degree of opening of the sliding gate 7 necessary for achieving the target in a manner described later. The result of calculation is provided to a cylinder control unit 2 as a control signal. Although not illustrated, the control signal provided to the cylinder control unit 2 is fed back to the level control unit 1.

The cylinder control unit 2 converts a positional control signal which is provided by the level control unit 1 to a velocity type control signal, and the converted signal is provided to a stepping cylinder 8 which acts as an actuator for the sliding gate 7. The stepping cylinder 8 is a translation actuator which is operated in response to a control spool moved by a rotation of a pulse motor 8*a*.

The cylinder control unit 2 determines a rotational direction and a rotational amount of the pulse motor 8*a* necessary for performing (executing) a control signal provided by the level control unit 1, and it outputs a drive pulse corresponding to the desired rotation to the driving circuit of the pulse motor 8*a*. A signal corresponding to the opening of the sliding gate 7 which is detected by an opening detector 7*a* is provided to the cylinder control unit 2.

On the path of withdrawal of cast slab 5, a device 9 for carrying out liquid core reduction (hereunder referred to as "liquid core reduction device") is disposed. This device is operated to apply a reduction in thickness to the cast slab 5 using a plurality of reduction rolls 9*a*, 9*a*, . . . , which are aligned in the direction of withdrawal of the cast slab so that an unsolidified core portion remaining within the cast slab 5 is removed to produce product casting slabs having a good internal structure. Control operations for the liquid core reduction device, such as switching from application of reduction to release of reduction, and increasing or decreasing the amount of reduction, are executed in accordance with an operation signal provided by the reduction control unit 90. The operation signal to the reduction control unit 90 is provided through the level control unit 1 from a process controller (not shown).

The withdrawal rate of the cast slab 5, which is controlled by rotation of pinch rolls 6, 6, is increased or decreased in accordance with a control signal provided to a driving source of the pinch rolls 6, 6 through a speed control unit 60. The operation signal to the speed control unit 60 is provided through the level control unit 1 from the before-mentioned process controller.

In the illustrated example, operation signals provided to the level control unit 1 include those to control the withdrawal rate and reduction speed.

Figure 2:
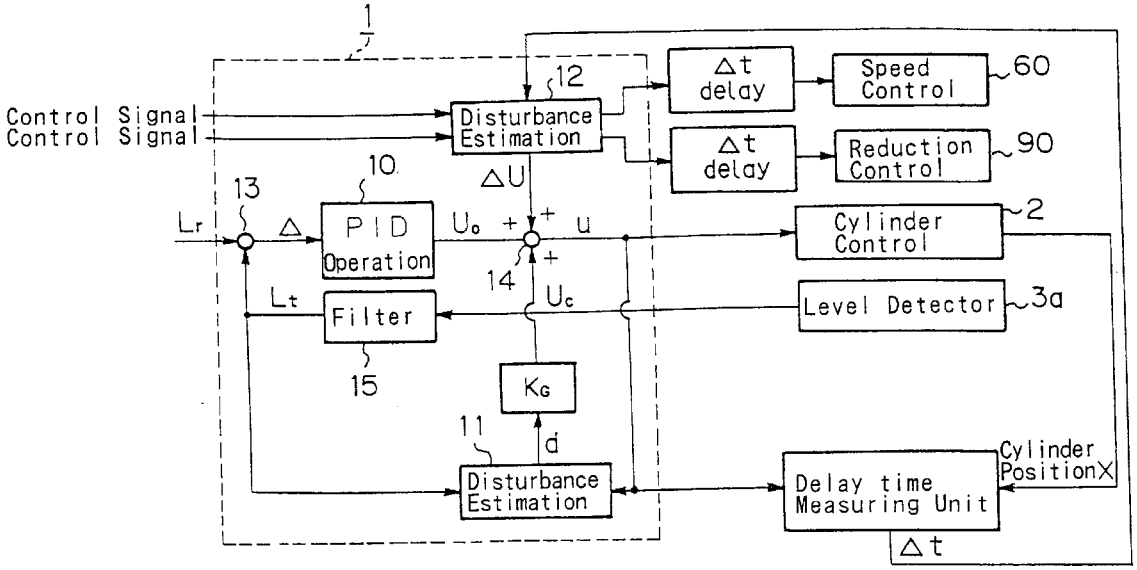
FIG. 2*a* is a block diagram showing an internal arrangement of a level control unit which can output a control signal to a pouring means in accordance with a method of the present invention.
FIGS. 2*b*–2*d* are views illustrating a delay time and a method of determining the delay time.
Figure 2:
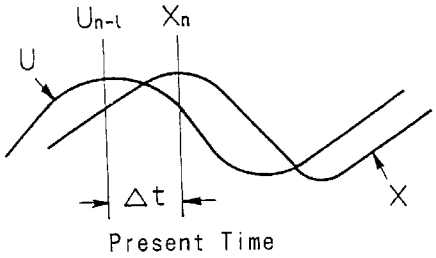
Figure 2:
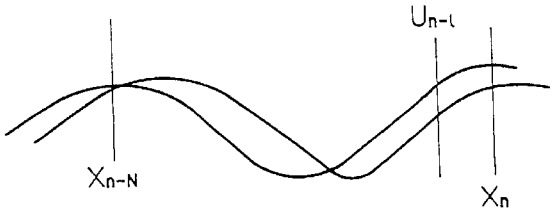
Figure 2:
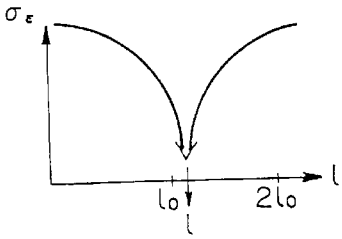

FIG. 2*a* is a block diagram showing an internal arrangement of the level control unit 1.

As shown, the level control unit 1 comprises a PID operation unit 10, a first disturbance estimating unit 11, and a second disturbance estimating unit 12. A target level $L_r$ input to the level control unit 1 and a molten metal level $L_t$ detected by the level detector 3*a* within a mold M are provided to an adder 13 disposed ahead of the PID operation unit 10. A deviation Δ between the two levels ($\Delta=L_r-L_t$) output from the adder 13 is provided to the PID operation unit 10.

In the PID operation unit 10, PID operation is carried out using predetermined control parameters to calculate a target opening degree $U_o$ for the sliding gate 7 necessary to make the deviation Δ be zero. The resulting target opening degrees $U_o$ is input to an adder 14. In addition, to this adder 14, an estimated disturbance d for the molten metal level, which is calculated and estimated in the first disturbance estimating unit 11, is multiplied by a predetermined gain $K_G$ and input as a corrected signal $U_c$. In the second disturbance estimating unit 12, an opening correction value ΔU is estimated and calculated. Thus, these values are added to the before-mentioned target opening value $U_o$ to give a control signal u as an output of the level control unit 1 (i.e., $u=U_o+U_c+\Delta U$).

To the first disturbance estimating unit 11, a molten metal level $L_t$ detected by the level detector 3*a* within a mold M is input together with the control signal u output from the level control unit 1 as a feedback signal.

An estimated disturbance d, i.e., an output from the front disturbance estimating unit 11, is an estimate of a variation of the molten metal level within the mold M, which is caused by such disturbances as deposition of solidified matter onto the sliding gate 7 or falling off thereof, and bulging of the cast slab 5, which occur during stable operation. The estimate can be obtained by a suitable calculation using control signal u and the level $L_t$ detected as a level variation within the mold M, which is caused by movement of the sliding gate 7 in response to the control signal u. It is already know how to calculate such a disturbance estimate d, and the present invention can employ such known procedures to calculate it. See Japanese Patent Application Laid-Open Specification No. 5-23811/1993.

The output of the level detector 3*a* contains a vibration component caused by oscillation of the mold M, and the detected level $L_t$ provided respectively to the PID operation unit 10 and the first disturbance estimating unit 11 is one from which the vibration component has been removed with a filter 15.

The other input to the level control unit 1, i.e., an operational control signal (operation signal) to be provided to the speed control unit 60 and reduction control unit 90 is input to the second disturbance estimating unit 12. When the input reaches the second disturbance estimating unit 12, following predetermined procedures, a variation of the molten metal level within the mold M is estimated based on the operation of speed control unit 60 or reduction control unit 90, which operate in accordance with the operation signal. Then, a correction ΔU of the opening of the sliding gate 7 is so determined that the estimated variation in the molten metal level can be eliminated, and the resulting correction ΔU is output to an adder 14 which adds it to the target opening $U_o$ to correct the control signal. Thus, the control signal u is corrected and a delay time Δt required until the sliding gate 7 operates in accordance with the control signal u incorporating the correction ΔU of the opening is determined. When the delay time Δt after stopping the operation signal has elapsed, an output to the speed control unit 60 or the reduction control unit 90 is carried out. Namely, the control signal u including the correction is output prior to the output of the operation signal by the delay time.

The delay time Δt, namely, a deviation between the waveforms of the operational control signal, i.e., operation signal and the operational position X can be measured based on the operational position X of the cylinder as shown in FIG. 2*b*.

Alternatively, an experimentarily determined value can be used as a delay time Δt and it can previously built onto a system for changing operation conditions.

In still another embodiment, the delay time may be obtained based on the hereinafter-explained equation (1).

FIG. 2*b* illustrates the logic to determine a delay time Δt of the movement of a cylinder. In response to the control signal u the operational position X of the cylinder moves with a delay time Δt.

The period of time between a position (Xn) at the present time and a position $U_{n-1}$ at which the cylinder operates at the response to the control signal, i.e., the delay time Δt of the cylinder movement can be described as follows.

Namely, $1=\Delta t/T_o$ wherein $T_o$: sampling intervals, and 1: number of times of sampling.

This will be further explained. The following equations can be set up, wherein Xn: operational position of the cylinder, Un: operation signal to the cylinder, and Δt: delay of the movement.

$$U_{n-1}X_n \text{ (n: a whole number)}$$

$$\epsilon_1=|U_{n-1}=X_n|$$

A various of the moving average $\sigma_\epsilon$ is calculated in a sampling interval N as shown in FIG. 2*c* for 1 which may be from zero to $21_o$ ($1_o$ is determined on the basis of design data under cold conditions), for example.

As shown in FIG. 2*d*, when the value of $\sigma_\epsilon$ is the minimum, the resulting 1 means a delay. This can be converted to real time to give $\Delta t=1\times T_o$.

As already mentioned, an operation signal provided to the speed control unit 60 is a signal to change the withdrawal rate of the cast slab 5 by changing the rotation of pinch rolls 6, 6. Similarly, an operation signal provided to the reduction control unit 90 is a signal to start the reduction, or release the reduction, or change the amount of reduction for the liquid core reduction device. These changes are all causes of a disturbance resulting in a rapid change in the molten metal level within the mold M.

Calculation of a correction ΔU of the opening is carried out in the second disturbance estimating unit 12 in order to eliminate a variation of the molten metal level such as that caused by these disturbances.

The liquid core reduction device under operation is taken as an example. When the device 9 is performing reduction, the molten metal level within the mold M rises. On the other hand, when the release of reduction takes place, the molten metal level within the mold M falls. In order to compensate for such a fluctuation of the molten metal level, the opening of the sliding gate 7 is adjusted, and there will be a time delay Δt between the control signal U and the movement of the sliding gate.

In the above case, calculation of the correction ΔU of the opening in the second disturbance estimating unit 12 can be carried out as follows.

Figure 3:
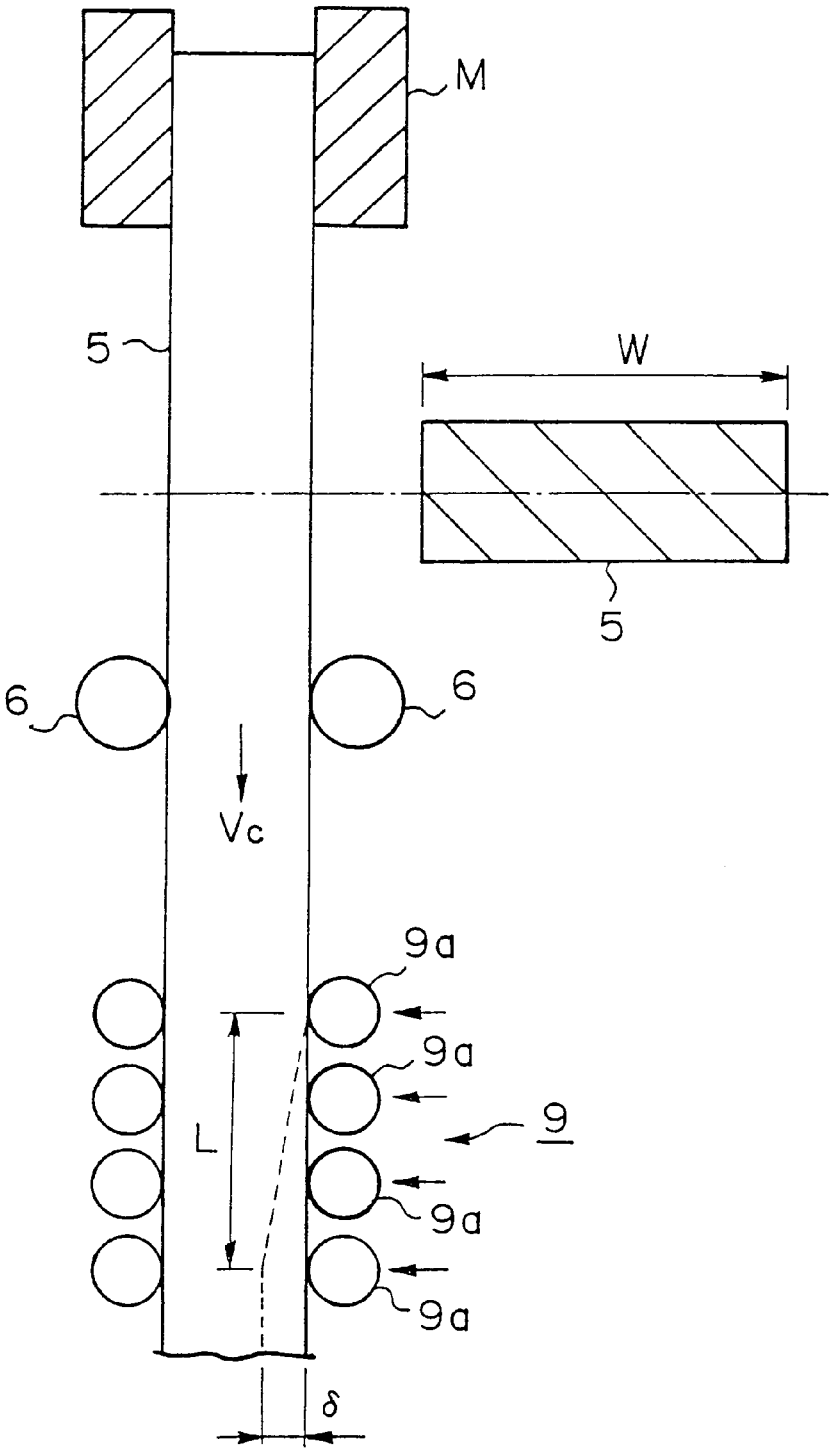
FIG. 3 is a view illustrating a mechanism by which a molten metal level is fluctuating in accordance with reduction produced by a liquid core reduction device.
Figure 4:
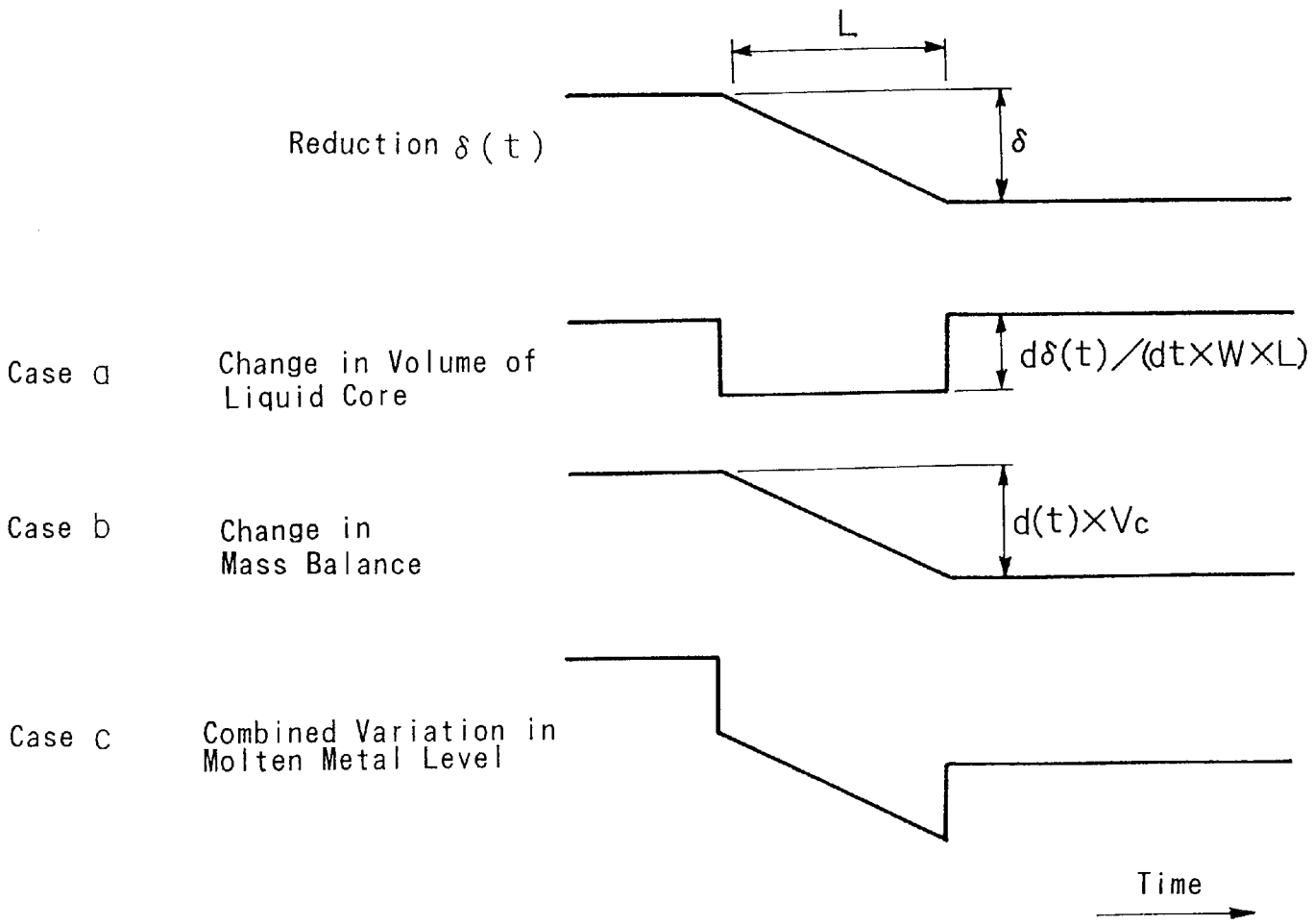
FIG. 4 is a chart showing changes in the molten metal level as a function of time.

FIG. 3 is a view illustrating a mechanism by which a molten metal level is varied due to reduction operation carried out by the liquid core reduction device, and FIG. 4 is a chart showing occurrence of changes in the molten metal level with respect to the elapse of time.

In the following example, the withdrawal rate Vc is described as being constant. When the rate is varied, the same procedures can be taken to determine the correction.

As shown in FIG. 3, by using reduction rolls 9*a*, 9*a*, . . . of the liquid core reduction device installed downstream of the mold M, an amount of reduction δ (t) is applied to the cast slab 5 so that a final amount of reduction δ is applied at a distance L. The volume of a liquid core of the cast slab 5 varies (decreases) in this reduction zone, and an amount of molten metal corresponding to this change in volume comes back upstream to change (to raise) the level. In the figure, for the sake of clarification, the reduction is carried out just on one side.

An amount of this change is described by the product of the reduction rate d δ(t)/dt, the width W of the cast slab 5, and the distance L along the slab S on which the reduction rolls operate. Under the conditions that the reduction rate Vc is constant, as shown as "case a" in FIG. 4, the amount of change is kept constant from the beginning to the end of the reduction.

On the other hand, since the thickness of the cast slab 5 is changed (decreased) in the reduction zone by the reduction rolls 9*a*, 9*a*, . . . , the amount of feed of the cast slab 5 downstream from the reduction zone is changed (decreased), and a change in mass balance upstream of the reduction zone will follow, resulting in a further change (increase) in the molten metal level within the mold M. This change can be described as the product of the reduction δ(t)×withdrawal rate $V_c$, which is varied, as shown in FIG. 4 as "case b", in proportion to the elapse of time after the beginning of reduction.

Thus, within the mold M, in fact, a variation of the molten metal level which is caused by the change of the volume of the liquid core and that caused by the change In the mass balance are put together to give, as shown in FIG. 4 as "case c", a combined variation in the molten metal level caused by combined change in mass balance. This combined fluctuation contains the former change, i.e., a stepwise variation caused by the change of volume of the liquid core.

In order to eliminate a fluctuation in the molten metal level, which is caused by the change of mass balance, control of a molten metal level is carried out using the sliding gate 7 as a means for adjusting the molten metal level. However, if a stepping cylinder 8 which is known to be quickly responsive is employed as an actuator and the sliding gate 7 quickly moves in response to the control signal from the level control unit 1, a delay in action of the sliding gate 7 is inevitable.

In the second disturbance estimating unit 12, a correction ΔU of the opening is determined using the following equation just after an operation signal is provided to the reduction control unit 90.

$$\Delta U = -K_1 \times V \times W \times L \tag{1}$$

wherein V: set point of the reduction velocity for the liquid core reduction device.

The correction ΔU of the opening, which is determined by the equation above, is obtained by multiplying a given control gain $K_1$ by an estimate (=V×W×L) for a stepwise variation caused by a change in volume of a liquid core of the cast slab 5 during operation of the liquid core reduction device.

Simultaneously, in the second disturbance estimating unit 12, a delay time Δt for the movement of the sliding gate actuated by a control signal u containing the opening correction ΔU determined by equation (1) is considered. The delay time Δt may be measured as described before. It may also be determined by using equation (1) having a different control gain $K_1$, since it is substantially proportion to a correction ΔU of the opening.

The second disturbance estimating unit 12 provides the opening correction ΔU of the opening calculated using equation (1) to an adder 14, and after that the unit 12 stops passing an operation signal to the liquid core reduction device until the delay time Δt elapses. Thus, the opening of the sliding gate 7, which can control the amount of molten metal poured into the mold M, will be changed in accordance with a control signal u having been corrected by the correction ΔU prior to commencement of operation of the liquid core reduction device by a time corresponding to a delay time Δt. The operation of the device 9 causes a fluctuation of the molten metal level.

After an operation signal is provided to the liquid core reduction device, calculation of a correction ΔU of opening is carried out in the second disturbance estimating unit 12 in accordance with the following equation in place of equation (1).

$$\Delta U = -K_1 \times V \times \int \left[ \frac{d\delta(t)/dt}{V} \right] \times W \times L - K_2 \times \delta(t) \times Vc \tag{2}$$

The second term of equation (2) is obtained by multiplying a given control gain $K_2$ by a variation corresponding to case b of FIG. 4, i.e., the variation (δ(t)×Vc) caused by a change of mass balance during operation of the liquid core reduction device. The first term is obtained by multiplying a given control gain $K_1$ by a stepwise variation caused by a change of volume of a liquid core of the cast slab 5, while the measured reduction velocity V described in equation (1) is corrected by the measured value (dδ(t)/dt).

According to the above operation, the control signal u is corrected by the opening correction ΔU, which is calculated using equation (1), prior to actual operation of the liquid core reduction device by a time period Δt. Thus, since the gliding gate 7 can start moving prior to the occurrence of a fluctuation of the molten metal level which will happen immediately after commencement of reduction, a delay in movement of the sliding gate 7 can be eliminated, and the molten metal level can be stabilized just after the commencement of operation of the liquid core reduction device.

When the operation of the liquid reducing device is finished, the before-mentioned calculation of the opening correction ΔU is carried out just before a period of time corresponding to the delay time Δt using the following equation which is obtained by removing the first term from equation (2).

$$\Delta U = -K_2 \times \delta(t) \times Vc \tag{3}$$

This process proceeds in reverse with respect to the starting process of the operation. Prior to the occurrence of a rapid fluctuation of the molten metal level, which is expected afterwards, the operation of the sliding gate 7 is commenced so as to suppress the fluctuation of the level as much as possible just after the end of operation of the liquid core reduction device.

EXAMPLES

Figure 5:
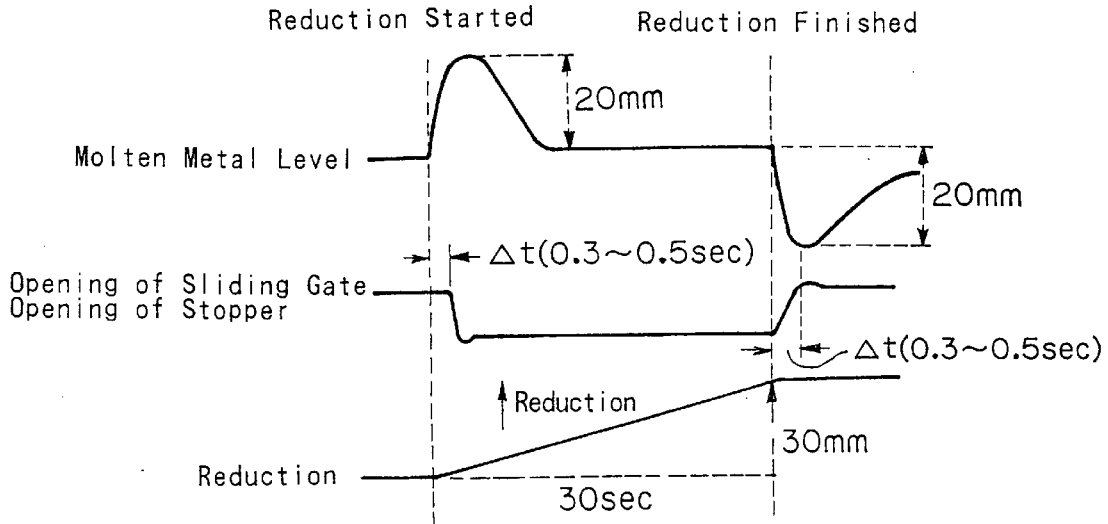
FIG. 5 is a chart showing results of experimental operation of a continuous casting machine carried out to confirm the effects of the method of the present invention.
Figure 5:
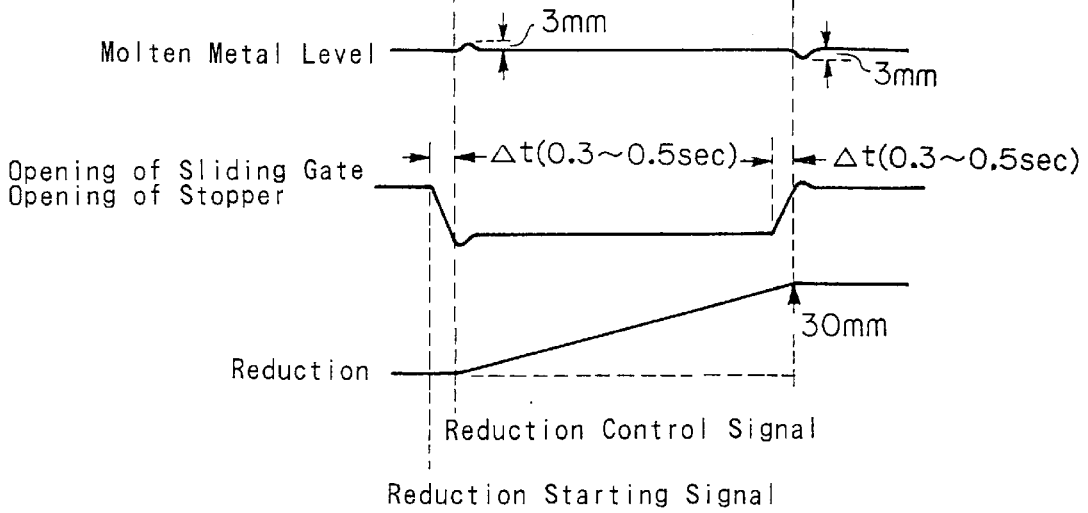
Figure 5:
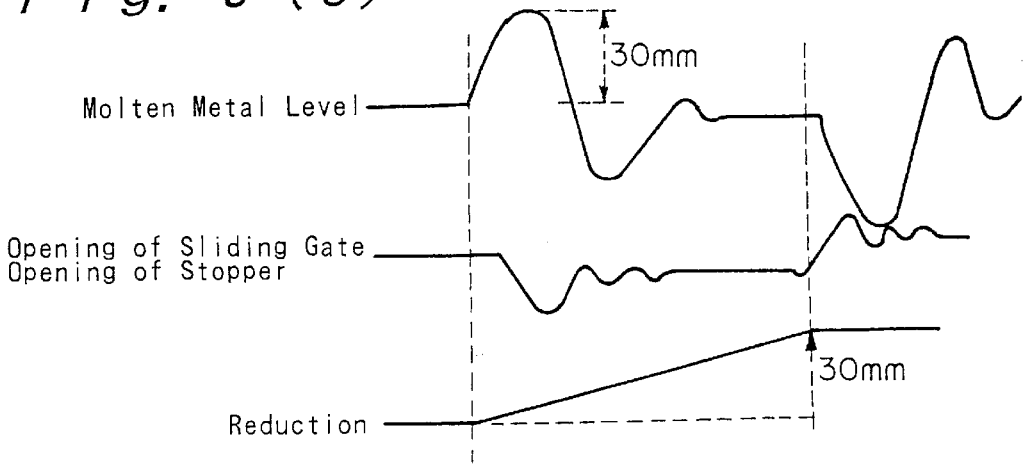

FIGS. 5*a* and 5*b* are charts each showing results of experimental operations using a continuous casting machine like that shown in FIG. 1, which were carried out so as to confirm the effect of the method of the present invention.

In the experimental operations, a reduction of 30 mm was carried out for 30 seconds using the liquid core reduction device. Correction of the control signal was carried out in accordance with equation (1) when the reduction was started. When the operation was shut down, the control of the molten metal level was continued by making correction in accordance with equation (2), but not equation (3).

FIG. 5*a* is a graph showing results of the prior art in which level control was carried out without consideration of a delay in time. It is noted that an overshoot of approximately 20 mm occurred. On the other hand, FIG. 5*b* shows results of the level control of the present invention, in which a reduction control was carried out, control of a resulting fluctuation of the molten metal level was carried out, and control was carried out taking the delay time into consideration. A fluctuation of the molten metal level was ±0.

FIG. 5*c* shows the results obtained by carrying out only PID control as a mere reference. It is noted that hunting occurred.

As is apparent from the results in the figures, the molten metal level can be maintained precisely at a position in close to a target level even immediately after the beginning of the operation when the timing control of the control signal is carried out taking a delay time Δt into consideration in accordance with the present invention. However, when timing control is carried out without consideration of the delay time Δt, an undershoot much lower than the target one occurs for the molten metal level just after ending of the reduction. Thus, it is apparent that application of the method of the present invention is effective for suppressing the occurrence of fluctuations which are caused by operation of the liquid core reduction device.

Although the present invention has been explained with reference to the correction of disturbances caused by operation of the liquid core reduction device, it is apparent that the method of the present invention is also effective when a change of operation conditions, such as a change of the withdrawal rate Vc of the cast slab 5 resulting from a change of rotation of pinch rolls 6, 6 causes a fluctuation of the molten metal level within the mold M. When the withdrawal rate Vc is varied, the method of the present invention is applicable by working the second disturbance estimating unit 12 in response to an input of an operation signal to the velocity control unit 60.

INDUSTRIAL APPLICABILITY

According to the method of the present invention, when operating conditions of a continuous casting machine are varied resulting in a fluctuation of the molten metal level within a mold, a disturbance that such a variation of the operating conditions causes to the molten metal level is estimated. A correction is determined to eliminate such a disturbance with respect to a control signal provided to a molten metal pouring means. A time delay is also determined with respect to the operation of the pouring means which works in response to a control signal which has been corrected. The corrected control signal is provided to the pouring means in advance by a time period of the delay time prior to commencement of changing of the operating conditions. Thus, it is possible to successfully suppress a fluctuation of the molten metal level caused by changes of operating conditions. It is also possible to keep precise control of the molten metal level during the entire operation of continuous casting including periods of changing the conditions, resulting in improvement in the yield of product slabs. The present invention, therefore, can provide various advantageous effects.

We claim:

1. A method for controlling a molten metal level within a mold of a continuous casting machine, which comprises detecting a molten metal level within a mold successively during casting operation, comparing a detected level with a target level to determine a difference between the two levels, applying a control signal to control a pouring means so as to make the difference be zero, and adjusting an amount of molten metal poured into the mold by the operation of the pouring means, characterized by the steps of: (i) estimating a disturbance to the molten metal level, which is caused by a change in operating conditions of a continuous casting machine before changing the operating conditions; (ii) determining an amount of correction of the control signal to eliminate the disturbance, and determining a delay time of the operation of the pouring means in response to the control signal after correction; and (iii) applying a control signal containing the amount of correction in advance by a period of the delay time prior to the occurrence of a change in operating conditions.

2. A method for controlling a molten metal level within a mold of a continuous casting machine as set forth in claim 1 wherein the change in operating conditions is a change of the withdrawal rate of cast slabs through pinch rolls and/or a change of reduction speed by a liquid core reduction device.

3. A method for controlling a molten metal level within a mold of a continuous casting machine as set forth in claim 1 wherein the degree of opening of a sliding gate is adjusted by the control signal.

4. A method for controlling a molten metal level within a mold of a continuous casting machine as set forth in claim 1 wherein the amount of the correction of the control signal is determined on the basis of the equation $$u=U_o+U_c+\Delta U$$

wherein u: control signal after correction, $U_o$: output of a PID operational section, $U_c$: estimated disturbance based on the operation signal to the cylinder control section.

* * * * *